US005135451A

United States Patent [19]

Chen

[11] Patent Number: 5,135,451

[45] Date of Patent: Aug. 4, 1992

[54] ADJUSTABLE WEIGHT LIFTING MACHINE

[76] Inventor: Ming-Che Chen, c/o Hung Hsing Patent Service Center, P.O. Box 55-1670, Taipei, Taiwan

[21] Appl. No.: 747,274

[22] Filed: Aug. 19, 1991

[51] Int. Cl.[5] ..... A63B 21/06

[52] U.S. Cl. ..... 482/98; 482/99; 482/138

[58] Field of Search ..... 272/117, 118, 123, 134, 272/DIG. 4; 482/94, 98, 99, 100, 101, 152, 153, 133, 135, 136, 137, 138

[56] References Cited

U.S. PATENT DOCUMENTS

| | | | |
|---|---|---|---|
| 3,912,263 | 10/1975 | Yatso | 272/118 |
| 4,346,888 | 8/1982 | Slabo | 272/118 |
| 4,582,319 | 4/1986 | Luna | 272/134 X |
| 4,634,127 | 1/1987 | Rockwell | 272/118 X |
| 4,781,374 | 11/1988 | Lederman | 272/134 |
| 4,826,157 | 5/1989 | Fitzpatrick | 272/134 |
| 4,915,377 | 4/1990 | Malnke et al. | 272/134 X |
| 4,919,419 | 4/1990 | Houston | 272/134 |

FOREIGN PATENT DOCUMENTS

| | | | |
|---|---|---|---|
| 2052274 | 1/1981 | United Kingdom | 272/118 |

*Primary Examiner*—Robert Bahr

[57] ABSTRACT

An adjustable weight lifting machine includes a bench board adjustably secured on a bench frame by adjustably engaging a locking bolt pivotally secured with the bench board with a corresponding pair of bolt holes formed in the bench frame adapted for a proper seating or sleeping by a trainee or user on the bench board, and a plurality of weights slidably held on two guiding rods having a pair of reinforcing ribs, each rib securing each rod to a supporting column of the machine having each weight formed with two side notches in two opposite side portions of the weight so as to be freely reciprocated on the guiding rods without being obstructed by the two reinforcing ribs secured on the rods.

1 Claim, 3 Drawing Sheets

ADJUSTABLE WEIGHT LIFTING MACHINE

BACKGROUND OF THE INVENTION

A conventional gym includes a bench board mounted on a frame to be seated or slept by a user, and a weight lifting means formed on the frame lifted by a user's hand for physical training purpose, which however may have the following drawbacks:

1. A plurality of heavy weights are slidably held on two weight columns to be lifted by the trainee to easily cause vibration of the columns which are not reinforced with any side ribs secured to two rear supporting columns of the gym. If it is expected to secure the weight columns of the weights onto the rear supporting columns, several ribs or plates must be provided to horizontally link the weight columns to the rear columns. However, the weights, of which each weight is not formed with any side notch therein, must be slidably reciprocated on the weight columns and will be obstructed by the reinforcing ribs linked between the weight columns and the rear columns so that the weight quantity placed on the machine will be quite limited to thereby limit the weight-lifting capacity and training efficiency for the trainee.

2. The bench board is fixedly mounted on the frame and is not adjustable, thereby limiting the machine for a single training use such as merely for training a trainee's chest muscle or possible reducing a training interest of the trainee.

The present inventor has found the drawbacks of a conventional gym and invented the present adjustable weight lifting machine.

SUMMARY OF THE INVENTION

The object of the present invention is to provide an adjustable weight lifting machine including a bench board adjustably secured on a bench frame by adjustably engaging a locking bolt pivotally secured with the bench board with a corresponding pair of bolt holes formed in the bench frame adapted for a proper seating or sleeping by a trainee or user on the bench board, and a plurality of weights slidably held on two guiding rods having a pair of reinforcing ribs, each rib securing each rod to a supporting column of the machine having each weight formed with two side notches in two opposite side portions of the weight so as to be freely reciprocated on the guiding rods without being obstructed by the two reinforcing ribs secured on the rods.

DETAILED DESCRIPTION

Figure 1:
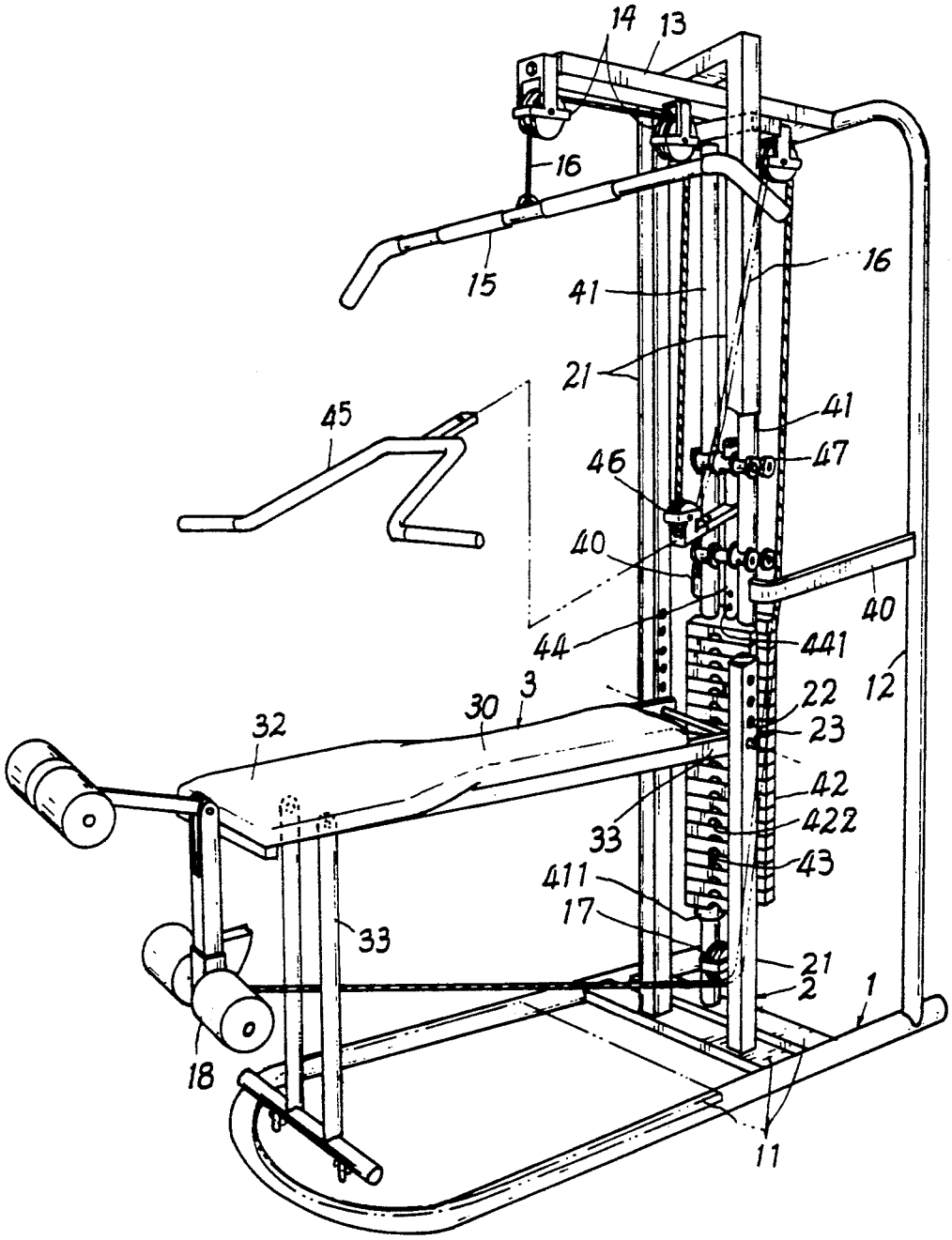
FIG. 1 is a perspective view of the present invention.

As shown in FIGS. 1–5, the present invention comprises: a main frame 1, a bench frame 2, a bench means 3, and a weight lifting means 4. The present invention is a modification or improvement from a conventional gym.

The main frame 1 is a conventional device of a gum and includes: a base 11, a pair of rear supporting columns 12 formed on a rear portion of the frame 1 protruding upwardly from the base 11, an upper girder 13 horizontally formed on an upper portion of the frame 1 having an upper pulley set 14 of a plurality of upper pulleys rotatably mounted on the upper girder 13 to be tensioned or wound by a rope 16 secured among a horizontal bar 15 hanged on the upper pulley set 14, a middle pulley 46 detachably formed on an upper portion of the lifting means 4, a lower pulley 17 rotatably secured on the frame 1 proximate to the base 11, and a knee machine 18 formed on front lower portion under a bench board 30 of the bench means 3.

The bench frame 2 generally U shaped includes two vertical bench columns 21 protruding upwardly from the base 11 of the main frame 1, each vertical bench column 21 having a plurality of column bolt holes 22 longitudinally formed in each bench column 21 to have one bolt hole in one bench column 21 horizontally projectively aligned with another bolt hole formed in the other bench column, and a locking bolt 23 pivotally secured with an inner bench portion 31 of the bench board 30 adjustably engageable with any pair of the column bolt holes 22 formed in the two bench columns 21.

The bench means 3 includes the bench board 30 having its outer bench portion 32 pivotally secured with two supporting leg members 33 mounted on the base 11 of the main frame 1.

The weight lifting means 4 is provided for training physical or muscle strength of a trainee or user, and includes: two guiding rods 41 protruding upwardly from the base 11 of the main frame 1, two reinforcing ribs 40 each rib 40 securing each guiding rod 41 to a rear supporting column 12, a plurality of weights 52 slidably held on the two guiding rods 41 and retained on two stoppers 411 formed on a lower portion of each guiding rod 41, a coupling latch 43 adjustably engaging a selected weight 42 with a central lifting pipe 44 vertically formed between the two guiding rods 41 to couple plural weights 42 positioned above the selected weight 42 engaged with the latch 43, and a hand grip 45 secured on an upper portion of the central lifting pipe 44 for raising the pipe 44 and the weights 42 coupled thereon. A middle pulley 46 may be rotatably mounted on an upper portion of the central pipe 44.

Figure 2:
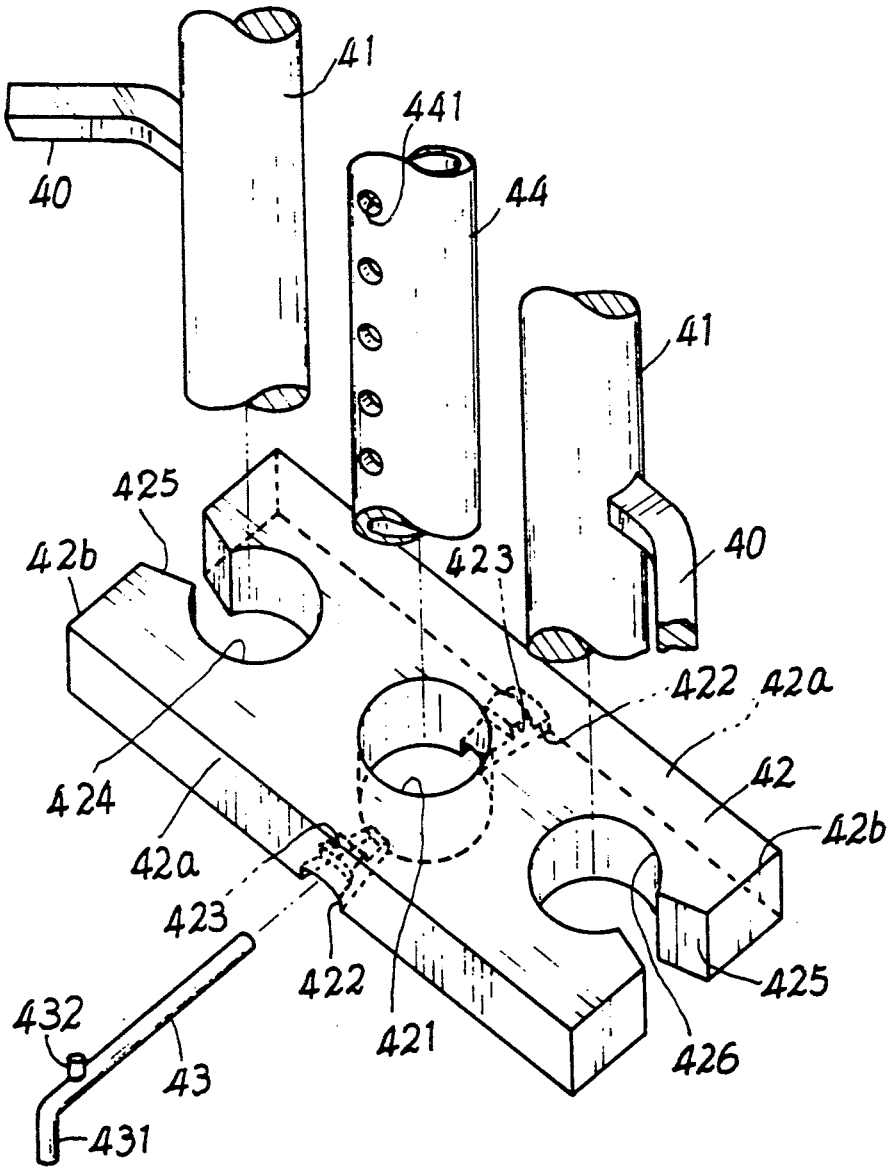
FIG. 2 is a partial perspective view of a weight lifting means of the present invention.
Figure 5:
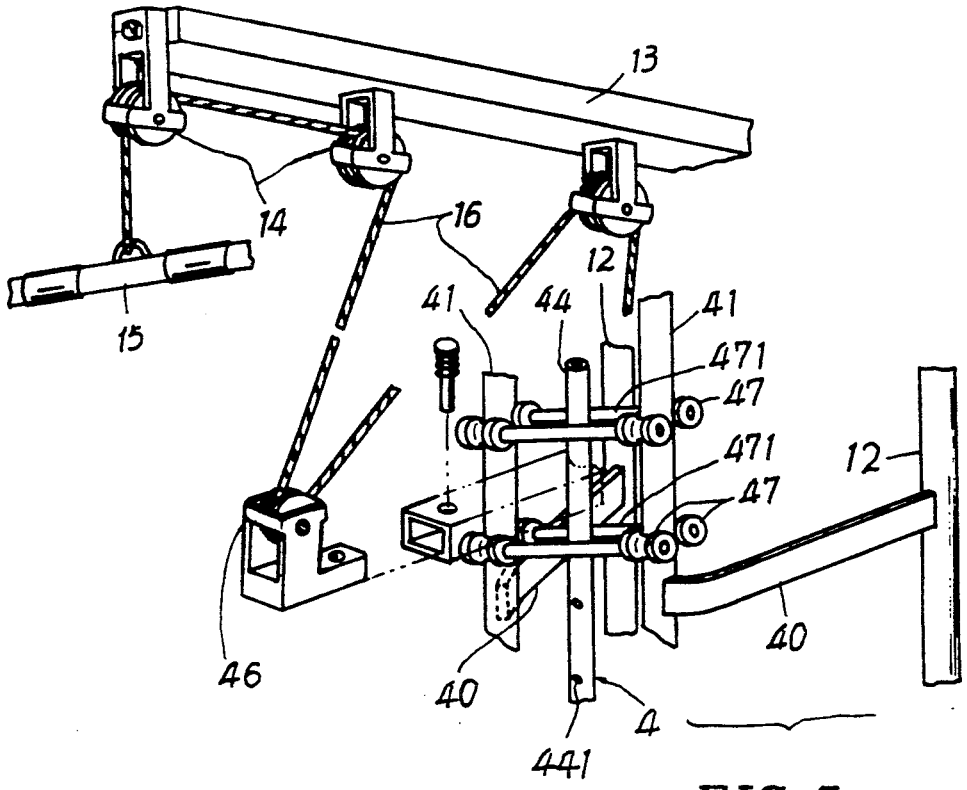
FIG. 5 is a partial perspective view of an upper portion of the present invention.
Figure 3:
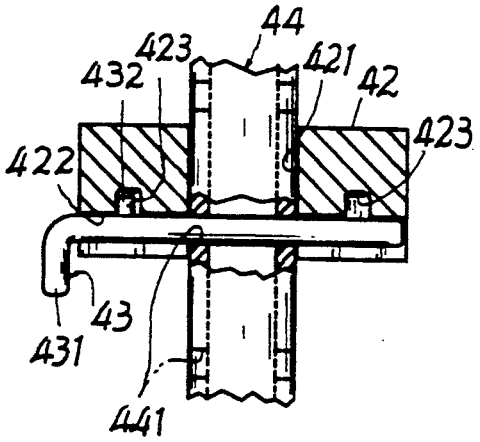
FIG. 3 is a sectional drawing of a weight of the present invention.
Figure 4:
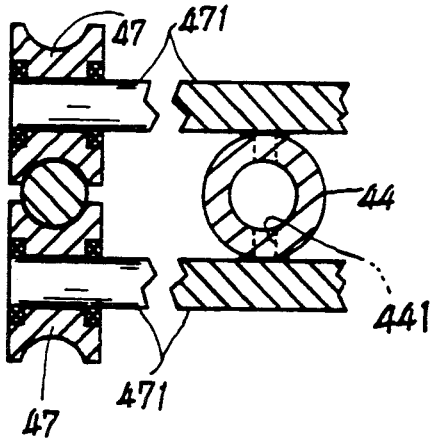
FIG. 4 is a partial sectional drawing showing a central lifting pipe and a guiding rod of the lifting machine.

Each weight 42 as shown in FIGS. 2, 3 includes a central pipe hole 421 engageable with the central lifting pipe 44 having a plurality of adjusting holes 441 longitudinally formed in the central lifting pipe 44, a latch hole 422 transversely formed through a central bottom portion of the weight 42 across a width between two longitudinal side edge portions **42*a* of the weight 42, a pair of lug sockets 423 respectively positioned on two sides of the central pipe hole 421 each the lug socket 423 having a depth deeper than that of the latch hole 441 recessed in the bottom of the weight 42 and each the lug socket 423 engageable with a locking lug 432 protruding from the coupling latch 43 proximate to a handle portion 431 of the latch 43, a pair of guiding-rod openings 424 respectively formed in two opposite side portions of the weight 42 slidably engageable with two guiding rods 41, and two open notches 425 each notch 425 notched through each latitudinal side edge portion 42*b* of the weight 42 and communicating with each guiding-rod opening 424 for slidably passing each reinforcing rib 40 secured on the guiding rod 41**. For engaging the latch 43 with each weight 42, the lug 432 of the latch 43 should be first positioned horizontally to poke into the latch hole 422 and then the handle portion 431 is rotated a right angle to engage the lug 432 with the socket 423 which is deeper than the hole 422, thereby preventing an unexpected withdrawal of the latch 43 for its stable locking purpose. At least two pairs of rollers 47 mounted on two roller shafts 471 are formed on the central pipe 44 for slidably engaging each pair of rollers 47 with each rod 41. Each roller shaft 471 is fixed on the pipe 44 for rotatably mounting two rollers 47 on two opposite ends of the shaft 471 as shown in FIGS. 4, 5. This mechanism is also conventional.

The present invention is superior to a conventional gym with the following advantages:

1. The bench board 30 can be adjustably mounted on the bench frame 2 for a properly seating or sleeping purpose by a user and for physically training many body portions of a trainee.

2. Each weight 42 having two open-end notches 425 can be slidably moved on the rods 41 without being obstructed by the reinforcing rib 40.

3. Each weight 42 can be optionally oriented to be mounted on the pipe 44 and rods 41 since the latch hole 422 is formed transversely across two side edges of the weight 42 and two lug sockets 423 are formed on a front and a rear side of the weight for ensuring an engagement of the locking lug 432 of the latch 43 with any lug socket 423 from either side of the weight 42 without paying attention to the assembly direction of the weight 42.

4. The reinforcing ribs 40 can be provided for strongly linking the rods 41 with the supporting columns 12 for preventing a vibration of the machine and for enhancing a sporting safety therefore.

I claim:

1. An adjustable weight lifting machine comprising:

a main frame, a bench frame mounted on said main frame, a bench means secured on said bench frame, and a weight lifting means secured on the main frame;

said main frame including a base, and a pair of rear supporting columns formed on a rear portion of the main frame protruding upwardly from the base;

said bench frame generally U shaped including two vertical bench columns protruding upwardly from the base of the main frame; said bench means including a bench board having an outer bench portion of said bench board pivotally secured with two supporting leg members mounted on the base of the main frame; and said weight lifting means including: two guiding rods protruding upwardly from the base of the main frame, two reinforcing ribs, each rib securing each guiding rod to said rear supporting column, a plurality of weights slidably held on the two guiding rods, a coupling latch adjustably engaging a selected weight with a central lifting pipe vertically formed between the two guiding rods to couple plural weights on the central lifting pipe, and a hand grip secured on an upper portion of the central lifting pipe for raising the central lifting pipe and the weights coupled thereon;

each said weight having a central pipe hole engageable with the central lifting pipe having a plurality of adjusting holes longitudinally formed in the central lifting pipe, a latch hole formed in a central bottom portion of the weight, and a pair of guiding-rod openings respectively formed in two opposite side portions of the weight slidably engageable with the two guiding rods;

said bench frame having each said vertical bench column formed with a plurality of column bolt holes longitudinally formed in each said bench column to have one bolt hole in one bench column horizontally projectively aligned with another bolt hole formed in the other bench column, and a locking bolt pivotally secured with an inner bench portion of the bench board adjustably engageable with any pair of the column bolt holes formed in the two bench columns; and said weight having said latch hole transversely formed through said central bottom portion of the weight across a width between two longitudinal side edge portions of the weight, a pair of lug sockets respectively positioned on two opposite sides of the central pipe hole each the lug socket having a depth deeper than that of the latch hole recessed in the bottom of the weight and each the lug socket engageable with a locking lug protruding from the coupling latch proximate to a handle portion of the locking latch, and having two open notches each said notch notched in each latitudinal side edge portion which is perpendicular to each said longitudinal side edge portion of the weight, each said notch communicating with each said guiding-rod opening for slidably passing each reinforcing rib secured on the guiding rod.

* * * * *